United States Patent [19]

Davies

[11] 3,966,464

[45] June 29, 1976

[54] ELECTRICAL CONTACT MATERIALS AND METHODS OF MAKING THE SAME

[75] Inventor: Terrence Ardern Davies, Horton, England

[73] Assignee: Square D Company, Park Ridge, Ill.

[22] Filed: Nov. 25, 1974

[21] Appl. No.: 526,889

Related U.S. Application Data

[62] Division of Ser. No. 384,157, July 30, 1973, Pat. No. 3,857,706.

[30] Foreign Application Priority Data

Aug. 25, 1972 United Kingdom ..... 39666/72

[52] U.S. Cl. ..... 75/173 R

[51] Int. Cl.[2] ..... C22C 5/06; C22C 1/03

[58] Field of Search ..... 75/173 R, 135, 169; 200/266

[56] References Cited

UNITED STATES PATENTS

| | | | |
|---|---|---|---|
| 550,360 | 11/1895 | Wurts | 200/266 |
| 1,719,365 | 7/1929 | Gray et al. | 75/173 R |
| 1,720,215 | 7/1929 | Gray et al. | 75/173 R |

*Primary Examiner*—L. Dewayne Rutledge
*Assistant Examiner*—E. L. Weise
*Attorney, Agent, or Firm*—Harold J. Rathbun; Richard T. Guttman; James S. Pristelski

[57] ABSTRACT

The contact materials comprise silver with additions of mercury or mercury and tellurium and silver-cadmium oxide compositions with additions of mercury and tellurium. The methods of making the materials include the steps of adding a silver-mercury alloy to molten silver and to a molten silver-tellurium powder mixture. The materials including cadmium oxide are produced by heating a mixture of powders of silver, a cadmium-tellurium compound, cadmium oxide, and mercuric oxide powders in a reducing atmosphere and then reoxidizing.

1 Claim, No Drawings

ELECTRICAL CONTACT MATERIALS AND METHODS OF MAKING THE SAME

This is a division, of application Ser. No. 384,157, filed July 30, 1973 now U.S. Pat. No. 3,857,706.

The invention relates to electrical contact materials for use in electrical contacts and to methods of producing the electrical contact materials.

It is an object of the invention to provide new and useful contact materials for use in electrical contacts which demonstrate desirable resistance to welding and arc-extinguishing characteristics, which have a relatively low contact resistance and which are relatively inexpensive and simple to produce.

The invention provides an electrical contact material which consists of a mixture of silver and not more than 3.0 weight per cent of mercury.

According to a feature of the invention an electrical contact material as outlined in the preceding paragraph is provided which includes not more than 3.0 weight per cent of tellurium.

According to another feature of the invention an electrical contact material as outlined in the preceding paragraph is provided which includes 2.5 to 20 weight per cent of cadmium oxide.

The invention also provides a method of producing an electrical contact material including the steps of providing a silver-mercury master alloy of a desired composition; adding the master alloy to molten silver under an inert atmosphere to provide a silver-based molten alloy having a mercury concentration of not more than 3.0 weight per cent; and casting the molten alloy to form an ingot.

The invention further provides a method of producing an electrical contact material including the steps of providing silver powder and tellurium powder; mixing the silver and tellurium powders together to provide a mixture containing not more than 3.0 weight per cent of tellurium; melting the silver-tellurium powder mixture under an inert atmosphere to provide a molten alloy; providing a silver-mercury master alloy; adding the master alloy to the molten silver-tellurium alloy under the inert atmosphere to provide a molten silver-tellurium-mercury alloy containing not more than 3.0 weight per cent each of mercury and tellurium; and casting the silver-tellurium-mercury alloy to form an ingot.

The invention further provides a method of producing an electrical contact material including the steps of providing irregular silver powder having a powder particle size of not greater than 350 mesh; providing a co-precipitated cadmium-tellurium powder compound having a powder particle aggregate size of not greater than 75 microns; providing cadmium oxide powder and mercuric oxide powder having a powder particle size of not greater than one micron; mixing the silver, cadmium-tellurium compound, cadmium oxide and mercuric oxide powders to provide a fine, evenly dispersed mixture containing the equivalent of 2.5 to 20 weight per cent of cadmium oxide, not more than 3.0 weight per cent of tellurium, not more than 3.0 weight per cent of mercuric oxide, and the remainder silver; heating the powder mixture in a reducing atmosphere to produce a silver-cadmium-mercury alloy powder having fine cadmium telluride particles dispersed over the surfaces of the powder particles; internally oxidizing the alloy powder to effect re-oxidation of the cadmium and the cadmium telluride; sieving the silver-based alloy powder so that the powder particle aggregate size is not greater than 100 mesh; compacting the alloy powder into a desired shape; and sintering the compacted shape in air within a sealed enclosure, the interior volume of the enclosure being only slightly larger than the volume of the compacted shape.

The foregoing and other features according to the invention will be better understood from the following description of specific embodiments of the invention.

The electrical contact materials according to the invention which are especially adapted for medium to low duty applications consist of a mixture of silver and mercury to an evenly dispersed concentration in the range 0.001 to 3.0 weight per cent, although it has been found that the preferred mercury concentration range is 0.001 to 0.5 weight per cent.

The silver therefore provides the bulk of the contact material and the contact material should be produced such that the mercury is spread uniformly throughout the silver.

The mercury effects a lowering of the electron energy of the break-arc drawn between electrical contacts fabricated from the silver based material when a circuit is broken by reducing the mean electron energy in the arc and changing the distribution of electron energies in the arc to eliminate the high energy electrons.

In addition, the mercury also tends to be ionized very easily in electrical discharges and is readily raised to excited optical states resulting subsequently in the emission of light quanta. The addition of mercury to silver electrical contacts thus vastly increases the tendency for inelastic collisions by electrons to occur in arcs drawn between them causing a significant reduction in the mean electron energy and in the relative number of electrons with high energies. Thus the electronic bombardment of the contacts become less severe resulting in less heating and leading to less volatilization and erosion. This beneficial effect occurs both for arcs drawn on contact closure and for those on contact opening.

Tellurium can be added to the electrical contact materials outlined in preceding paragraphs to a concentration in the range 0.001 to 3.0 weight per cent although it has been found that the preferred range is 0.001 to 0.25 weight per cent. The tellurium when present effects embrittlement of the silver matrix, particularly grain boundary embrittlement, and thus contributes to the breaking of the welds which tend to form when contact is established between electrical contacts.

Cadmium oxide can be added to the silver-mercury-tellurium electrical contact materials outlined in the preceding paragraph to a concentration in the range 2.5 to 20 weight per cent. The cadmium oxide also effects embrittlement of the welds which tend to form when contact is established between electrical contacts. Furthermore, the cadmium vapor which is present in the arc that occurs when contact between electrical contacts fabricated from this silver-based material is broken reduces the mean electron energies in the arc and changes the distribution of electron energies in the arc thereby to eliminate the high energy electrons.

The electrical contact materials according to the invention can be produced by any one of several techniques, for example, powder metallurgical techniques or inert gas melting techniques.

In a method according to the invention for producing silver-mercury electrical contact materials, a silver-mercury master alloy of a desired composition, for example 60%Ag/40%Hg, is added to molten silver under an inert gas atmosphere and then immediately cast to form a silver-mercury ingot having an evenly distributed mercury concentration of not more than 3.0 weight per cent.

The silver-mercury ingot is then forged and rolled into sheet form.

Electrical contacts of the desired shape and size are then stamped out of the sheet material.

The silver-cadmium oxide-tellurium-mercury electrical contact materials according to the invention are best produced by powder metallurgical techniques, and in order to obtain a perfectly uniform distribution of the tellurium throughout the contact material, the tellurium is best added in combination with cadmium in the form of a chemically co-precipitated compound.

The co-precipitated compound of cadmium and tellurium can be obtained by a process which includes the steps of:

a. carefully dissolving the required amounts of cadmium oxide and tellurium oxide powders in hot concentrated nitric acid, using the minimum necessary amount of acid;
b. heating the liquor to drive off any excess acid when the oxides have dissolved,
c. precipitating, in known manner, insoluble cadmium-tellurium compound(s) from the liquor with sodium carbonate solution;
d. allowing the resulting fine white precipitate to settle, washing carefully by decantation with distilled water and then filtering the precipitate;
c. washing the precipitate on the filter bed with distilled water and acetone and then drying the filtrate at 60°C in an air oven;
f. decomposing the precipitate by heating in a suitable vessel in a furnace operating in air for a period of approximately 2 hours at a temperature of approximately 450°C, the temperature of the furnace being raised to this level in about one hour, this produces a fine powder mixture of cadmium oxide and a mixed oxide of cadmium and tellurium in intimate dispersion, the color of the powder mixture ranging from chocolate brown at low tellurium levels, e.g. 0.6 weight per cent to orange at higher tellurium levels, e.g. 14.0 weight per cent;
g. rewashing the decomposed precipitate to remove any traces of sodium contamination and drying the washed precipitate at a temperature of approximately 100°C, the color of the precipitate changing during washing and drying to a pale yellow due to hydration; and
h. refining the washed decomposed precipitate in air for a period of approximately 2 hours at a temperature of approximately 450°C in order to drive off the water of hydration.

The resulting co-precipitated powder, which contains cadmium and tellurium perfectly uniformly distributed throughout in accurately known quantities, is then sieved through a 75 micron screen before being used in the production of the silver-cadmium oxide-tellurium contact material.

Commercially available cadmium oxide and tellurium powder having a minimum assay of 99% can be utilized to produce the co-precipitated compound, a typical commercially available cadmium oxide material being "Reagent Grade" cadmium oxide powder produced by Hopkins and Williams Limited of Great Britain. This cadmium oxide powder, which is produced by burning cadmium and condensing the smoke that the burning causes, is of cubic morphology and the powder particles are less than one micron. Also, on chemical analysis the powder was found to have the following composition:

| | |
|---|---|
| Cadmium oxide as CdO | 99.0% min. |
| Chloride (Cl) | 0.005% max. |
| Sulphate ($SO_4$) | 0.005% max. |
| Iron (Fe) | 0.001% max. |
| Potassium (K) | 0.002% max. |
| Sodium (Na) | 0.01% max. |

The minute amounts of the additional materials Cl, $SO_4$, Fe, K and Na were found to have no significant effect on the performance of the electrical contacts produced from material which included this CdO powder.

The commercially available powders should be kept clean and dry in storage to prevent moisture absorption. The powder storage could be effected by the use of desiccators.

Thus in a method according to the invention for producing silver-cadmium oxide-tellurium-mercury electrical contact materials, irregular silver powder is intimately mixed in the desired proportions with mercuric oxide powder and the co-precipitated cadmium tellurium powder, diluted when necessary with cadmium oxide powder, such as the aforementioned commercially available cadmium oxide powder.

The size and shape of the powder particles are of prime importance in the manufacture of optimum silver based contact materials and the powders should preferably be an fine as is economically possible. This involves the use of irregular silver powder with a powder particle size of not greater than 350 mesh, yellow mercuric oxide powder having a powder particle size of not greater than one micron, and cadmium-tellurium powder having a powder particle aggregate size of not greater than 75 microns. The use of fine powders ensures that a fine, evenly dispersed mixture of the materials is obtained in the electrical contact material that is produced.

A typical commercially available reagent grade mercuric oxide powder that can be utilized is produced by British Drug Houses and a typical commercially available silver material that can be utilized is "Thessco" silver powder produced by Sheffield Smelting Company, a subsidiary of Engelhard Industries. This silver powder, which is a precipitated powder of commercial purity is of irregular morphology having a powder particlesize of less than 300 mesh and an apparent density of 1.9 gms/cc. This material also has (i) a geometric means linear intercept by transmission microscopy of 17.8 microns, standard deviation 2.0, and (ii) a geometric mean linear intercept on a polished section of 4.1 microns, standard deviation 2.0. This commercially available silver powder is sieved before being used in the method according to the invention in order to remove the powder particles which are of a size greater than 350 mesh.

It is important to note that these commercially available materials should also be kept clean and dry in storage in order to prevent moisture absorption, contamination and surface corrosion. The powder storage could for example be effected by using desiccators.

The intimate mixing of the constituent powders can be effected by dry tumble milling. In order for the dry tumble milling to be effective for these powders it is important that the following mixing conditions are adhered to:

a. The constituent powders should have a particle size as specified above.
b. The powders should be desiccator stored, or stored with some alternative means being employed of preventing absorption of moisture and surface corrosion:
c. The volume to be mixed should be from 50 grams upwards: the actual mixing time being dependent upon the size of the mix:
d. The constituent powders should be in the desired proportion.
e. The volume of the drum should be of the order of 2 to 10 times the volume of the powder being mixed in order to prevent the movement of the powder being restricted.
f. The relative humidity inside the drum should be in the range 0 to 70% and the inside drum temperature should be in the range 10° to 30°C.
g. The speed of rotation of the drum should be such that the powders are continually in motion during mixing. Increasing the speed of rotation of the drum will decrease the time required for good mixing and decrease the tendency of the oxide to aggregate. If the speed of rotation is excessive, however, then, due to the influence of centrifugal forces, mixing will be hindered.
h. The duration of powder mixing is generally dependent upon the volume of the additional materials being added to the silver, the larger the volume of the additional materials, the longer the mixing time. For example, when the volume of the additional materials is 2.5 weight per cent, the mixing period should be of the order of 12 hours whereas with an additive volume of 10 or 15 weight per cent the mixing period should be of the order of 24 hours. The use of substantially shorter periods of mixing than the ones specified, especially for powders of high moisture contents, results in the incomplete breaking down of aggregates in the oxide powder. On the other hand, excessive periods of continuous mixing, especially under moist conditions, for example, far in excess of 100 hours, can result in a tendency to de-mix, due to the growth of aggregates.

It should, however, be noted that the most significant variable in attaining a fine uniform dispersion of the constituent powders throughout the contact material is the absolute and relative sizes of the constituent powder particles and the optimum mixing schedule is largely determined by this factor.

Satisfactory mixing conditions for the aforementioned powders in mixing volumes in the range of to 1000 grams and an additive volume of mercuric oxide, cadmium-tellurium compound and cadmium oxide in the range 2.5 to 15 weight per cent were found to be:

a. The drum volume was of the order of 2 to 10 times that of the powders being mixed;
b. The mixing was carried out at 20°C (range 17°C to 23°C) with a relative humidity of approximately 60% (range 45 to 65%);
c. The drum was revolved at 160 r.p.m.;
d. The duration of mixing was 24 hours.

These mixing conditions have been found for the particular powders employed to give a uniformly mixed composite powder. When the oxide powders had an excessive moisture content and correspondingly increased tendency to aggregate, it was found necessary to sieve the powder through a 350 mesh sieve after the 24 hours tumbling operation and to then retumble the sieved powder mixture for a further 24 hour period.

After mixing, the powder is placed in a suitable flat vessel, such as a quartz tray, to a depth not exceeding 1 cm, and is then heated to between 200°C and 700°C in an atmosphere of hydrogen. At all temperatures in this range, the hydrogen reduces the cadmium oxide to cadmium and the mercuric oxide to mercury which diffuse into the silver and form a silver-cadmium-mercury alloy powder with very fine cadmium telluride particles dispersed over the surfaces of the alloy powder particles. At temperatures above 321°C, the cadmium is liquid, and homogenization of the alloy involves liquid phase mechanisms. The final stages of homogenization involve solid state diffusion processes. Sintering of the alloy particles also occurs, but should be avoided as far as possible. The sintering however is very loose and easily broken down by sieving. The presence of the sub-micron telluride particles greatly facilitates the breaking down of the loosely sintered product into a powder, especially when the tellurium content is greater than about 0.2 weight per cent. After sieving through a 500 mesh screen, the alloy is in the form of small aggregated lumps. A temperature of 400°C was found suitable for the reduction process, while at the same time avoiding excessive sintering and loss of cadmium and mercury due to volatilization. The temperature of 400°C should be maintained for 1 hour: the mixed powders being brought to this temperature at the rate of 200°C per hour.

The reduction process can be made continuous by using a belt furnace. In such an event automatic mixing and sieving apparatus could be used.

The sieved alloy powder is then subjected to internal oxidation to effect re-oxidation of the cadmium and the fine cadmium telluride particles, the cadmium being converted to cadmium oxide and the fine cadmium telluride particles to a complex oxide containing cadmium and tellurium. This can be effected by passing the powder through a belt furnace containing any suitable oxidizing atmosphere, for example air or oxygen, at pressures which may be below, equal to, or above atmospheric pressure. The temperature can be between 350°C and the melting point of the alloy but the preferred temperature is 500°C. The time required for oxidation depends on the partial pressure of the oxygen in the atmosphere of the furnace in use, the cadmium content of the alloy, the temperature used, and the size of the particles of the alloy powder. These factors may be assessed in known manner, allowance being made for the fact that the alloy powder that is produced during this method is finer than alloy powders hitherto available.

The internally oxidized alloy powder is then sieved to a degree of fineness suitable for subsequent use. If the material is sieved to below 100 mesh, the powder has an apparent density of about 15% of the theoretical density and has good flow properties. The alloy powder is then compacted at a pressure of 40 tons per square inch using molds into a desired shape, for example, the shape of the electrical contacts to be produced.

The compacted shape is then sintered for a period of one hour in air at a temperature of 930°C within a sealed enclosure, for example, in a quartz ampoule under one third of an atmosphere of air. The interior volume of the enclosure is arranged so that it is only slightly larger than the volume of the compacted shape.

The advantage of using a small atmosphere arises from the fact that very little mercury from the material is required to raise the vapor pressure to its equilibrium value so that the bulk of the mercury is retained within the material and is not lost to the atmosphere. If the compacts ar sintered in an unrestricted volume of air, then the mercury is lost very rapidly.

The density of the contact material can be increased, if desired, by a stamping or coining operation at a pressure of 45 tons per square inch.

The silver-mercury-tellurium contact materials according to the invention are best produced by a method which includes the steps of intimately mixing fine, irregular silver powder with ultra fine tellurium powder by the dry tumble mixing process outlined above, to provide a fine, evenly dispersed mixture containing not more than 3.0 weight per cent of tellurium, and the remainder silver. The silver and tellurium powders can be provided by the aforementioned commercially available powders.

The silver-tellurium powder mixture is then melted under an inert gas atmosphere, for example, by induction heating using a graphite container forming a single turn secondary.

A silver-mercury master alloy of a desired composition, for example, 60%Ag/40%Hg, is then added to the molten silver-tellurium alloy under the inert gas atmosphere to provide a molten silver-tellurium-mercury alloy containing not more than 3.0 weight per cent of mercury and tellurium.

The molten silver-tellurium-mercury alloy is then immediately cast to form an ingot.

The silver-tellurium-mercury ingot is then forged and rolled into sheet form.

Electrical contacts of the desired shape and form are then stamped out of the sheet material.

it is to be understood that the foregoing descriptions of specific examples of this invention are made by way of example only and are not to be considered as a limitation in its scope. The mesh sizes given herein are British Standard.

What we claim is:

1. A method of producing an electrical contact material including the steps providing a silver-mercury master alloy of a desired composition; adding the master alloy to molten silver under an inert atmosphere to provide a silver-based molten alloy having a mercury concentration of not more than 3.0 weight percent; casting molten alloy to form an ingot; and forging and rolling the ingot into sheet form.

* * * * *